US010801293B2

(12) United States Patent
Shampine

(10) Patent No.: US 10,801,293 B2
(45) Date of Patent: Oct. 13, 2020

(54) TOOL LOCATING TECHNIQUE

(71) Applicant: SCHLUMBERGER TECHNOLOGY CORPORATION, Sugar Land, TX (US)

(72) Inventor: Rod William Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/752,465

(22) PCT Filed: Aug. 11, 2016

(86) PCT No.: PCT/US2016/046441
§ 371 (c)(1),
(2) Date: Feb. 13, 2018

(87) PCT Pub. No.: WO2017/030875
PCT Pub. Date: Feb. 23, 2017

(65) Prior Publication Data

US 2019/0010778 A1 Jan. 10, 2019

Related U.S. Application Data

(60) Provisional application No. 62/205,560, filed on Aug. 14, 2015.

(51) Int. Cl.
*E21B 33/068* (2006.01)
*E21B 47/09* (2012.01)
*E21B 33/06* (2006.01)

(52) U.S. Cl.
CPC ..... *E21B 33/068* (2013.01); *E21B 33/06* (2013.01); *E21B 47/09* (2013.01)

(58) Field of Classification Search
CPC ..... E21B 33/068; E21B 33/06; E21B 47/09
See application file for complete search history.

(56) References Cited

U.S. PATENT DOCUMENTS

| | | | | |
|---|---|---|---|---|
| 3,435,895 | A | 4/1969 | Lee | |
| 2005/0055163 | A1 | 3/2005 | Hopper | |
| 2007/0051512 | A1 | 3/2007 | Markel et al. | |
| 2008/0277122 | A1 | 11/2008 | Tinnen | |
| 2008/0302530 | A1 | 12/2008 | Shampine et al. | |
| 2013/0043044 | A1 | 2/2013 | Garber et al. | |
| 2018/0313177 | A1* | 11/2018 | Jordan | E21B 33/062 |

OTHER PUBLICATIONS

International Search Report and Written Opinion issued in International Patent Appl. No. PCT/US2016/046441 dated Nov. 16, 2016; 13 pages.

* cited by examiner

*Primary Examiner* — David J Bagnell
*Assistant Examiner* — Brandon M Duck
(74) *Attorney, Agent, or Firm* — Rodney Warfford

(57) ABSTRACT

A system and technique for locating a tool in a channel of a blowout preventer. The system and technique may include the use of a tool locating device that includes flappers to detect tool components of a toolstring for a well application. The toolstring is segmented with deployment bars and tool components of differing diameters. For example, the deployment bars may be of a diameter that substantially matches that of an associated conveyance such as coiled tubing whereas the tool components may be of larger detectable diameters by the flappers. Once more, the flappers may also serve a centralization function as the conveyance is run through the blowout preventer.

17 Claims, 7 Drawing Sheets

TOOL LOCATING TECHNIQUE

CROSS REFERENCE TO RELATED APPLICATION(S)

This Patent Document claims priority under 35 U.S.C. § 119(e) to U.S. Provisional Application Ser. No. 62/205,560, entitled Tool Locating Device, filed on Aug. 14, 2015, which is incorporated herein by reference in its entirety.

BACKGROUND

Exploring, drilling and completing hydrocarbon and other wells are generally complicated, time consuming, and ultimately very expensive endeavors. As a result, over the years, a significant amount of added emphasis has been placed on well profiling, monitoring and maintenance. By the same token, perhaps even more emphasis has been directed at initial well architecture and design. All in all, careful attention to design, monitoring and maintenance may help maximize production and extend well life. Thus, a substantial return on the investment in the completed well may be better ensured.

From the time the well is drilled and continuing through to various stages of completions and later operations, profiling and monitoring of well conditions may play a critical role in maximizing production and extending the life of the well as noted above. Certain measurements of downhole conditions may be ascertained through permanently installed sensors and other instrumentation. However, for a more complete picture of well conditions, an interventional logging application may take place with a logging tool advanced through the well. In this way depth correlated information in terms of formation characteristics, pressure, temperature, flowrate, fluid types, and others may be retrieved. So, for example, an overall production profile of the well may be understood in terms of the dynamic contributions of various well segments. This may provide operators with insight into expected production over time and guidance in terms current or future corrective maintenance.

Regardless, detecting and monitoring of well conditions by way of a logging application has become a more sophisticated undertaking over the years. In addition to advancements in instrumentation, the well itself is more likely to be of greater depths and more complex architecture. That is, as opposed to merely dropping the logging tool into a vertical well in order to acquire readings, the logging tool may need to be routed through different tortious horizontal sections. Thus, coiled tubing is often employed for advancement of the logging tool through the entirety of the well.

During a coiled tubing operation, a spool of pipe (i.e., a coiled tubing) with a downhole tool at the end thereof is slowly straightened and forcibly pushed into the well. This may be achieved by running coiled tubing from the spool, at a truck or large skid, through a gooseneck guide arm and injector which are positioned over the well at the oilfield. In this manner, forces necessary to drive the coiled tubing through the deviated well may be employed, thereby advancing the tool through the well.

Advancing the logging tool through the well with coiled tubing first requires that the tool and the coiled tubing be deployed through a blowout preventer at the wellhead. The blowout preventer is the hardware utilized at the wellhead as a matter of safety and well control to ensure that the well itself remains sealed off and isolated from the environment of the oilfield. This works by positioning the tool and leading end of the coiled tubing into the blowout preventer with a master valve at the bottom thereof in a closed position. The blowout preventer may then sealingly engage with a higher point on the coiled tubing, the master valve opened and the coiled tubing advanced through the blowout preventer and well head therebelow. Indeed, this manner of deployment is generally utilized whether the intervention is coiled tubing driven, wireline or by some other mode. In the case of coiled tubing, an injector and other equipment are also utilized to further assure isolation between the well and the environment of the oilfield.

The described scenario of blowout preventer deployment is also utilized during retrieval of the coiled tubing and tool, though in reverse. Regardless, challenges are presented when the logging tool is of an extensive length. That is, the ability of the tool to be fully received within the blowout preventer with sealing thereabove before opening a master valve therebelow may be quite difficult when the tool is 50-100 feet in length or more as is the case with many more sophisticated logging tools currently available. In many cases, this challenge is addressed through the use of a riser assisted technique. In theory, a tubular riser may be of any practical height and circumference for accommodating the tool. Thus, the coiled tubing secured tool may be placed within a sealed riser that is run through the blowout preventer. In this way, the riser may provide an outer surface against which the blowout preventer may seal and allow for opening of the valve and advancement of the tool within the riser until sealing against the coiled tubing is available.

The riser assisted technique of deployment (or retrieval) helps address the issue of allowing sealing against the deployed equipment in spite of the excessive length of the tool that itself cannot be sealed against. Unfortunately though, as a practical matter, the issue of dealing with the deployment and retrieval of tools of such excessive lengths remains for other reasons. Specifically, a crane or raised platform may be utilized to position the riser and tool vertically over the well. However, when considering the cumulative height of the wellhead, plus the blowout preventer, plus a riser large enough to hold a 50-100 ft. tool, the platform or crane elevation needed to erect all of this equipment vertically can readily become impractical.

In order to reduce the height of extensive tools for sake of a more practical deployment and later retrieval, efforts to segment such tools have been suggested with the tool being separated into three, four or more segments with a deployment bar located between adjacent segments. That is, a tool segment may be provided with a deployment bar coupled thereto, followed by another tool segment that is coupled to the deployment bar. Subsequently, another deployment bar may be coupled to this other tool segment and this process may continue until a toolstring of tool segments and intervening deployment bars is completed. In theory, during deployment or retrieval a tool segment may be advanced into the blowout preventer with sealing taking place sequentially at a deployment bar above the tool segment and/or with the master valve at another deployment bar below the tool segment. This type of sealing above and below each tool segment may be repeated as the tool segments are deployed or retrieved from the well. Unfortunately however, this technique of moving a segmented tool through a blowout preventer takes place without any visibility to where a given tool segment actually is during sealing thereabove or below. Thus, the technique presents the possibility of sealing against a tool segment and damaging the tool, losing the seal or even risking a blowout. This is particularly of concern during tool retrieval due to the possibility of coiled tubing stretching during deployment which can make ascertaining the precise position of tool segments nearly impossible.

SUMMARY

A method of positioning a toolstring at a well wherein the toolstring is aided by coiled tubing and has at least one deployment bar and at least one downhole tool. The method includes moving one of the coiled tubing and the deployment bar through an orifice of a blowout preventer that is defined in part by deflectable flappers. During this moving, a closing force may be applied on the flappers and translated to the coiled tubing or deployment bar to attain centralization thereof. At least one of the flappers may be contacted by the tool of the toolstring. This contact may be detected so as to ascertain the position of the tool at the flappers within the blowout preventer.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments herein are described with reference to certain types of logging applications. For example, a logging tool may be provided in the form of an extended toolstring of alternating logging tool components and deployment bars. Of course, a variety of different types of application tools may take advantage of the unique deployment and tool component locating features detailed herein. For example, the toolstring may be adapted for performing different types of interventional applications such as a coiled tubing driven cleanout. Regardless, so long as the toolstring incorporates deployment bars capable of being sealed against within a blowout preventer and the preventer includes a tool locater therein, appreciable benefit may be realized.

Figure 1:
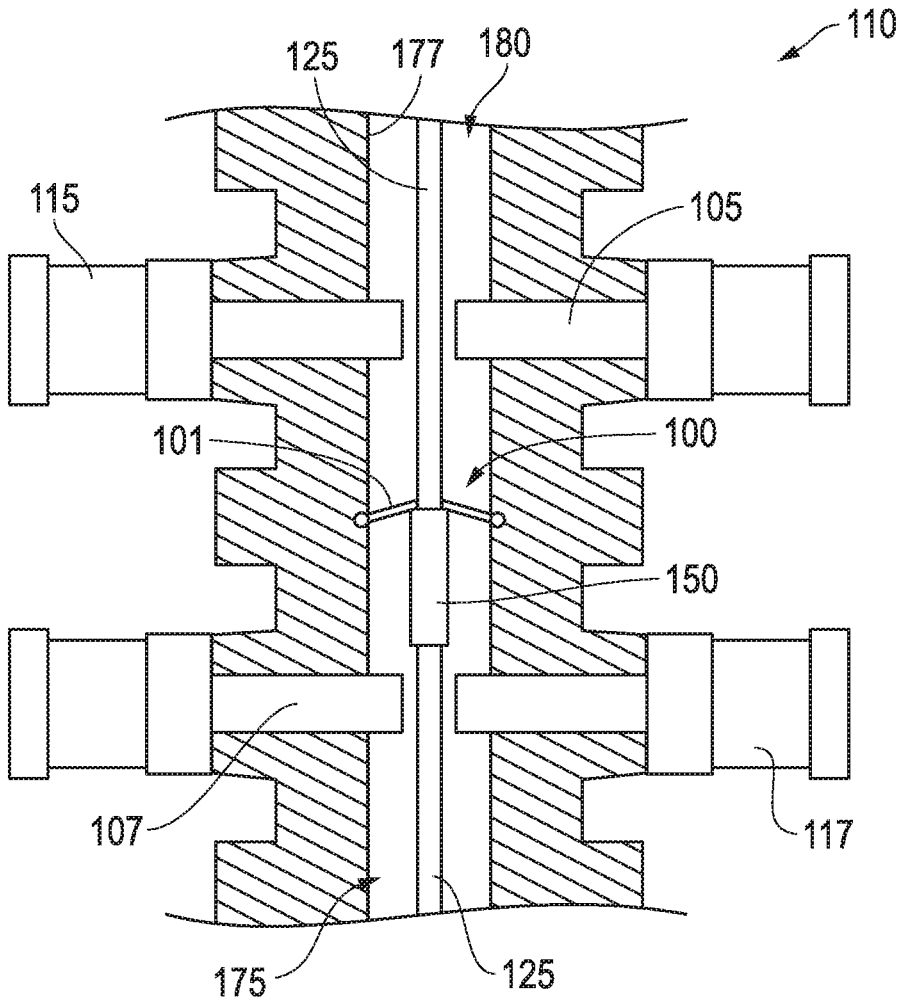
FIG. 1 is a side cross-sectional view of a blowout preventer with a tool locating device therein for interfacing with a downhole toolstring.

Referring now to FIG. 1, a side cross-sectional view of a blowout preventer 110 is shown with a tool locating device 100 therein for interfacing with a downhole toolstring 175. The blowout preventer 110 is a piece of equipment generally utilized at an oilfield 300 to help maintain isolated pressure control over a well 380 (see FIG. 3). Thus, in addition to providing a guide-path for well access, the preventer 110 may help to avoid undesired consequences of losing well control, such as a blowout, as the name suggests. In the embodiment of FIG. 1, features of the blowout preventer 110 include valves 115 with sealing elements 105, 107 for emerging from a sidewall 177 defining a channel 180 through the preventer 110. Thus, the elements 105, 107 may sealably engaging with the toolstring 175 as needed. For example, ends of the elements 105, 107 for engaging the toolstring 175 may terminate in a semicircular fashion and impart 4,000-10,000 lbs. of radial force on the toolstring 175. That is, a pair of adjacent elements 105 or 107 may be actuated to interface the toolstring 175 from opposite sides thereof, to attain a conformal seal about the toolstring 175. In this manner, well control may be maintained, for example, even if a well valve below the blowout preventer 110 has been opened to allow for well access via the channel 180. As a result, an operator may be allowed to thread a device such as the toolstring 175 through the preventer 110 in an incremental fashion. Of course, the blowout preventer 110 is also equipped with additional features such as shear rams to cut the toolstring 175, coiled tubing or other devices should the need for immediate well control isolation arise.

Continuing with reference to FIG. 1, both sets of elements 105, 107 are shown open with the toolstring 175 being passed through the noted channel 180. For example, following a downhole logging application with the toolstring 175, it may be withdrawn from the well (see arrow 600 of FIG. 6) with the elements 105, 107 open. Alternatively, as discussed further below, the channel 180 may be open to accommodate a tubular riser within which the toolstring 175 is incrementally assembled and advanced downward into the well 380 (see FIG. 3).

Figure 3:
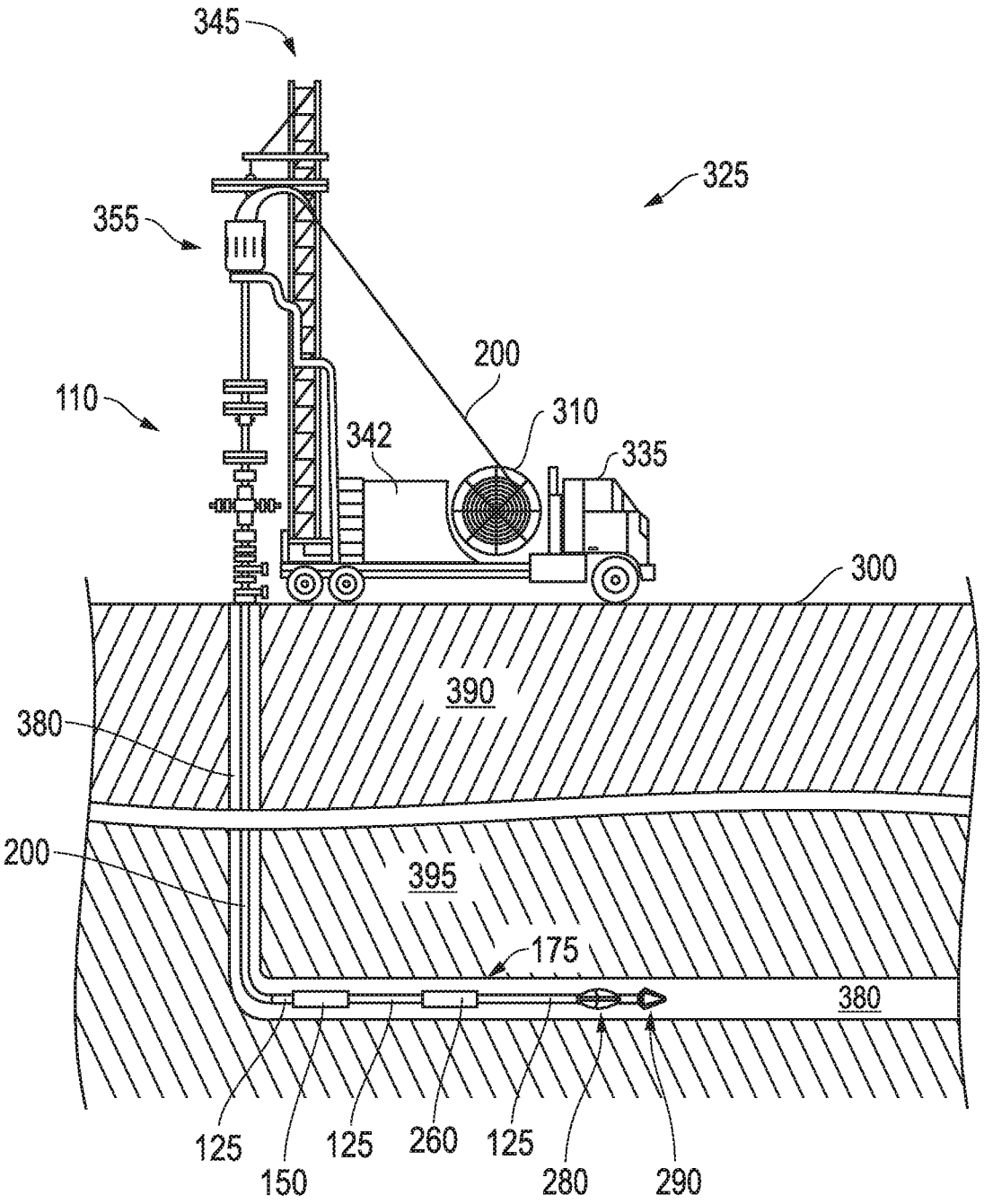
FIG. 3 is an overview of an oilfield with a well accommodating the toolstring of FIG. 2 routed through the tool locating equipped blowout preventer of FIG. 1.

Whatever the case, as noted above, the need to periodically close or seal elements 105, 107 about the toolstring 175 arises for sake of maintaining well control when accessing a channel 180 that leads to the well 380 (again, see FIG. 3). Once more, as a matter of allowing for assembly of the toolstring 175 on-site for a practical deployment, it may be made up of individual components such as the depicted sonde 150 secured to deployment bars 125. In this way, rather than attempt to introduce an extensively long premanufactured toolstring 175 of say over 50 feet or more, one toolstring component may be partially advanced into the blowout preventer 110, followed by securing thereof to a deployment bar 125, then another component (e.g. 150), then another deployment bar 125, and so forth. As a result, the toolstring 175 may be considered a segmented toolstring 175 which is advanced downward into the blowout preventer 110 at the same time that it is attaining length. Thus, the need to provide a platform of impractical deployment heights of 50 to 100 feet or more over the preventer 110 in order to drop in the toolstring 175 may be avoided.

While deployment may be aided with a tubular riser as noted above, this may not always be desirable. Once more, where the toolstring 175 is, for example, logging equipment run on coiled tubing, during withdrawal, the opportunity to utilize a tubular riser may not be available. Instead, the elements 105, 107 are configured to engage specifically with deployment bars 125 of the described toolstring 175 which are better suited to take on such sealing forces without structural harm thereto. In this way a potentially harmful or compromised sealing with larger diameter, more irregular components (e.g. 150) of the toolstring 175 may be avoided. Thus, visibility as to the location of such components is provided by way of the tool locating device 100.

The tool locating device 100 of FIG. 1 is shown as a logging tool component 150 is being pulled upward and a shoulder of the component 150 comes into engagement with flappers 101 of the device 100. As discussed further below, this leads to an upward deflection of the flappers 101 which may be detected by an operator thereby providing position information of the logging tool component 150. This detection may be through conventional modes such as change in load on the coiled tubing or the flapper, the degree of flapper deflection, touch sensing capability of the flappers 101 or tool component 150 or through other conventional modes. Regardless, in the embodiment shown, with the particular sonde component 150 located at the flappers 101, either of the element pairs 150, 107 may be directed by an operator to seal adjacent deployment bars 125 as needed as a measure of well control.

Figure 2:
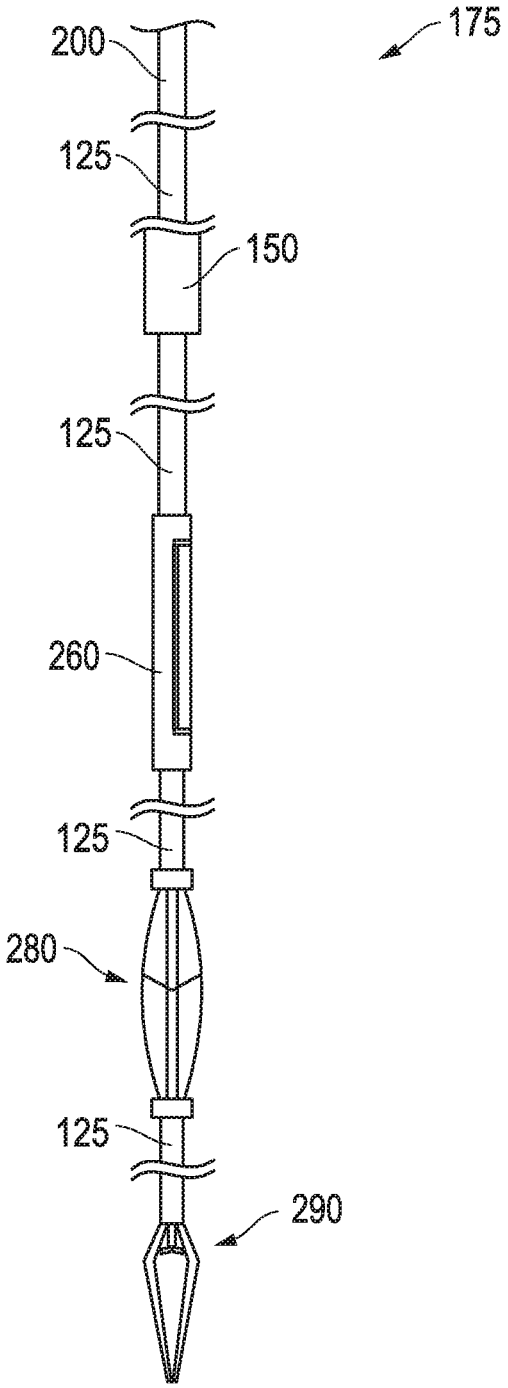
FIG. 2 is a side view of the downhole toolstring of FIG. 1 with embodiments of deployment bars incorporated therein.

With added reference to FIG. 2, attaining knowledge of tool component location within the blowout preventer 110 as described above may be beneficial where the deployment is by way of coiled tubing, particularly during withdrawal of the toolstring 175. For example, where the toolstring 175 is utilized for a logging application several thousand feet into a well and delivered by way of coiled tubing 200, the possibility of bending, stretching and other factors may make ascertaining the precise location of the toolstring 175 and its components (e.g. 150) challenging. That is, in such circumstances, the reeling back in of the coiled tubing 200 over a reel 310 following an application may not match the same amount that is let out at the outset of the application due to the noted stretching (see FIG. 3). Thus, a direct confirmation of the location of the toolstring components with the tool locating device 100 may be of particular advantage to allow for proper sealing with the elements 105, 107 at the deployment bars 125.

Referring now to FIG. 2, a side view of the downhole toolstring 175 of FIG. 1 is shown which utilizes deployment bars 125 located between toolstring components (e.g. 150, 260, 280, 290). As indicated above, the toolstring 175 is configured for deployment by way of coiled tubing 200. Further, deployment bars 125 are utilized to serve as connection structure between adjacent tool components 150, 260, 280, 290 while also being durably configured for sealing engagement with elements 105, 107 as noted above. For compatibility with the coiled tubing 200, the deployment bars 125 may support internal fluid flow and substantially match the outer diameter of the coiled tubing 200. For example, in one embodiment, both the coiled tubing 200 and the deployment bars 125 are of a 2⅜ inch variety. Of course, any suitable size for the application at hand may be utilized. Additionally, like the coiled tubing 200, the deployment bars 125 are also capable of being sheared by shear rams of the blowout preventer 110 should the necessity arise (see FIG. 1).

Due to the number of tool components 150, 260, 280, 290, the fully assembled toolstring 175 may be in excess of 50 feet in length, particularly when accounting for the addition of the deployment bars 125. However, due to the use of the deployment bars 125, the toolstring 125 may be assembled right on site over the blowout preventer 110 of FIG. 1. Thus, as a practical matter, the operator will generally handle only a single bar 125 or component 150, 260, 280, 290 at any given point in time, either of which is likely under 30 feet in length. As illustrated herein, alternatingly coupling components 150, 260, 280, 290 with deployment bars 125 makes this type of on-site assembly and deployment possible. Further, utilizing a tool locating device 100 as depicted in FIG. 1 makes this type of deployment through the blowout preventer 110 and, perhaps more beneficially, retrieval therefrom, practical and safe.

The toolstring components depicted in FIG. 2, include a sonde 150 as alluded to above. The sonde 150 is equipped to acquire basic measurements such as pressure, temperature, casing collar location and others. Additionally, density acquisition 260 and gas monitoring 280 components are also provided. The toolstring 175 also terminates at a caliper and flow imaging component 290 which, in addition to imaging, may be employed to acquire data relative to tool velocity, water, gas, flow and other well characteristics. Readings from a logging toolstring 175 as described may be acquired as the toolstring 175 is forcibly advanced through a well 380 as shown in FIG. 3 by coiled tubing 200. Such readings may be stored and interpreted at surface following a logging application or perhaps relayed over fiber optics, wirelessly or via other means to surface equipment for real-time interpretation and use. Regardless, in spite of the extended length of the toolstring 175 with a host of different logging components utilized, a practical manner of deployment and retrieval is rendered through the combined use of deployment bars 125 with a tool locating device 100 of the blowout preventer 110 (see FIG. 1).

Continuing now with reference to FIG. 3, an overview of an oilfield 300 is shown with a well 380 accommodating the toolstring 175 of FIG. 2 routed through the tool locating equipped blowout preventer 110 of FIG. 1. The well 380 is depicted accommodating the toolstring 175 during a logging application for building a production profile of the well 380. Advancement of the toolstring 175 as described above is directed via the coiled tubing 200. Surface delivery equipment 325, including a coiled tubing truck 335 with reel 310, is positioned adjacent the well 380 at the oilfield 300. With the coiled tubing 200 run through a conventional gooseneck injector 355 supported by a rig 345 over the well 380, the coiled tubing 200 and assembly 100 may then be advanced once the toolstring 175 is assembled and secured thereto.

As noted above, assembling of the toolstring 175 may take place with an operator manually assembling things piece by piece at a platform just over the blowout preventer 110 before the injector 355 is secured thereto. Specifically, the operator may secure one component (e.g. 290) to a deployment bar 125, followed by another component 260, another bar 125, another component 260, another bar 125, another component 150 and finally another bar 125. This last deployment bar 125 may then be secured to the coiled tubing 200 that emerges from the injector 355 prior to securing of the injector 355 to the blowout preventer 110. The coiled tubing 200 may then be forced down through the preventer 110 and through the well 380 traversing various formation layers 390, 395 (e.g. allowing the production logging application to proceed).

As detailed above, in sequentially assembling and advancing the toolstring 175 into the preventer 110, a tool location device 100 may periodically provide location information to the operator so as to allow for safely maintaining well control. This location information may be attained and analyzed by a control unit 342. In the embodiment shown, the control unit 342 is computerized equipment secured to the truck 335. However, the unit 342 may be of a more mobile variety such as a laptop computer. Furthermore, the unit 342 may be used to monitor logging readings or to direct the logging application itself among others.

Figure 4A:
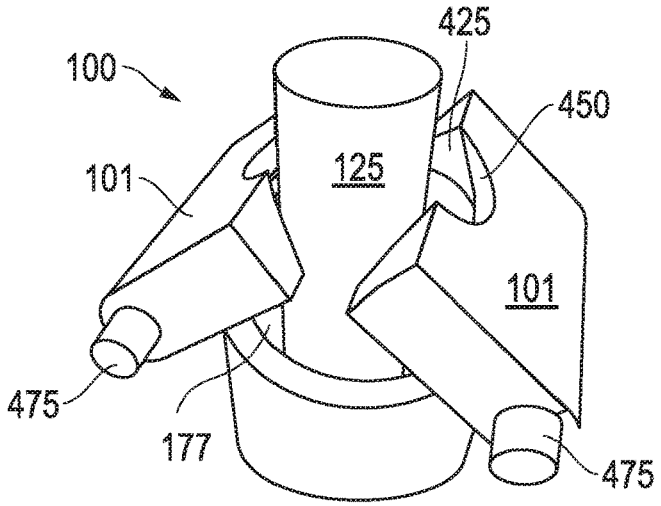
FIG. 4A is a schematic side perspective view of the tool locating device of FIG. 1 accommodating a deployment bar.
Figure 4B:
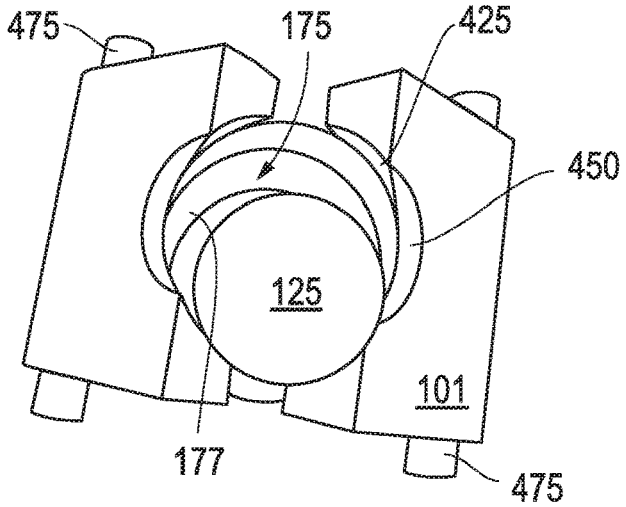
FIG. 4B is a schematic top perspective view of the tool locating device of FIG. 4A with the accommodated deployment bar.
Figure 4C:
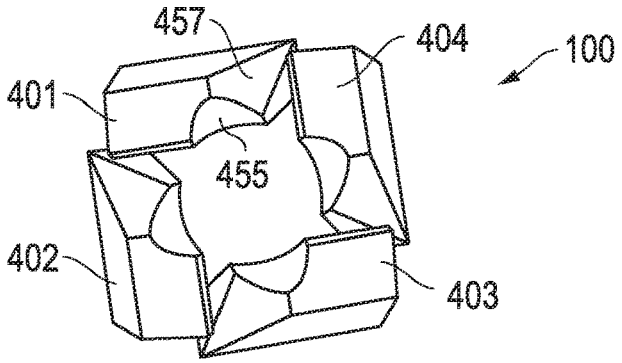
FIG. 4C is a schematic top perspective view of an alternate embodiment of a tool locating device.

Recalling that the combined use of deployment bars 125 with a tool locating device 100 allows for the safe on-site assembly and retrieval of a toolstring 175 of extended length, FIGS. 4A-4C, show schematic side and top perspective views of the tool locating device 100 of FIG. 1. Specifically, FIGS. 4A and 4B show the device 100 accommodating a deployment bar 125.

With added reference to FIGS. 1 and 2, in the views of FIGS. 4A and 4B, the flappers 101 of the locating device 100 are shown slightly deflected upward revealing both lower 425 and upper 450 tapered surfaces of about 45°. However, the deflection is not yet due to interfacing of the flappers 101 with a tool component as shown in FIG. 1 (e.g. 150). So, for example, in the views of FIGS. 4A and 4B, the deployment bar 125 along with the remainder of the toolstring 175 may be moving upward and being retrieved from the well 380. The flappers 101 may be secured to the hardware of the blowout preventer 110 through hinges 475 that are hydraulically or pneumatically powered to provide a degree of biasing force downward during such retrieval. Thus, the flappers 101 may deflect upward slightly as the coiled tubing 200 or deployment bar 125 is retrieved. However, they may also avoid full deflection and help to centralize the coiled tubing 200 and deployment bar 125 as they move through the blowout preventer 110. Of course, once the larger profile tool component (e.g. 150 of FIG. 1) reaches the flappers 101, a full deflection may take place sufficient to alert the operator of the position of the component within the blowout preventer 110. In one embodiment where the tool component is of a diameter that is more than about ⅛ of an inch larger than the coiled tubing 200 and/or deployment bars 125, such a level of deflection may be achieved. For example, where the coiled tubing 200 is 2⅜ inches in diameter and the component is more than about 2½ inches in diameter, such a deflection may be attained.

With added reference to FIG. 1, in certain embodiments, the flappers 101 may be unidirectional. That is, during deployment, the flappers may be retracted upward and more fully aligned with the sidewall 177 defining the channel 180 of the preventer 110. In this way, the toolstring 175 may be fully advanced past the locating tool 100 during the described incremental assembly. Such an assembly may include the periodic closing of the flappers 101 followed by an upward pull on the toolstring 175 to confirm location of any recently incorporated toolstring component (e.g. 150). In such an embodiment, the lower tapered surface 425 of the flappers 101 may be of particular benefit given the fact that physical interfacing between the toolstring 175 and the flappers 101 would generally be initiated from the lower side of the flappers 101. In this way, biting engagement by the flappers 101 that might damage or immobilize the toolstring 175 or coiled tubing may be avoided. Further, in an embodiment where the flappers 101 are bidirectional and capable of deflecting downward during deployment or retrieval of the toolstring 175, the upper tapered surface 450 may also be of notable benefit to avoid any unintended biting engagement with the toolstring 175 or coiled tubing 200 (see FIG. 2).

In the embodiments detailed above, the locating device 100 has included two flappers 101. For example, multiple flappers 101 provide the added ability to centralize coiled tubing 200 and the toolstring 175 as described. However, more than two flappers may be utilized such as in the embodiment depicted in FIG. 4C where four flappers (401, 402, 403, 404) are utilized. In this embodiment, an upper tapered surface 455 is again provided to each flapper 401-404. Furthermore, in addition to lower tapered surfaces (not visible), side tapered surfaces 457 may be provided to allow for a smoother collapse of the flappers 401-404 against one another when not deflected. Using more than two flappers 401-404 may provide an added degree of flexibility in terms of the amount of load and force that may be imparted through the flappers 401-404, for example, in centering coiled tubing 200 as an application proceeds as shown in FIG. 3.

In addition to the embodiment of FIG. 4C, the locating device 100 may employ still more flappers along the lines of deflectable metal reinforcing segments of the type that are often utilized about a circumferential elastomeric blowout preventer seal. As with the flappers detailed above, these may also impart a centralizing force while also deflectable to a point sufficient to indicate tool location thereat.

Figure 5B:
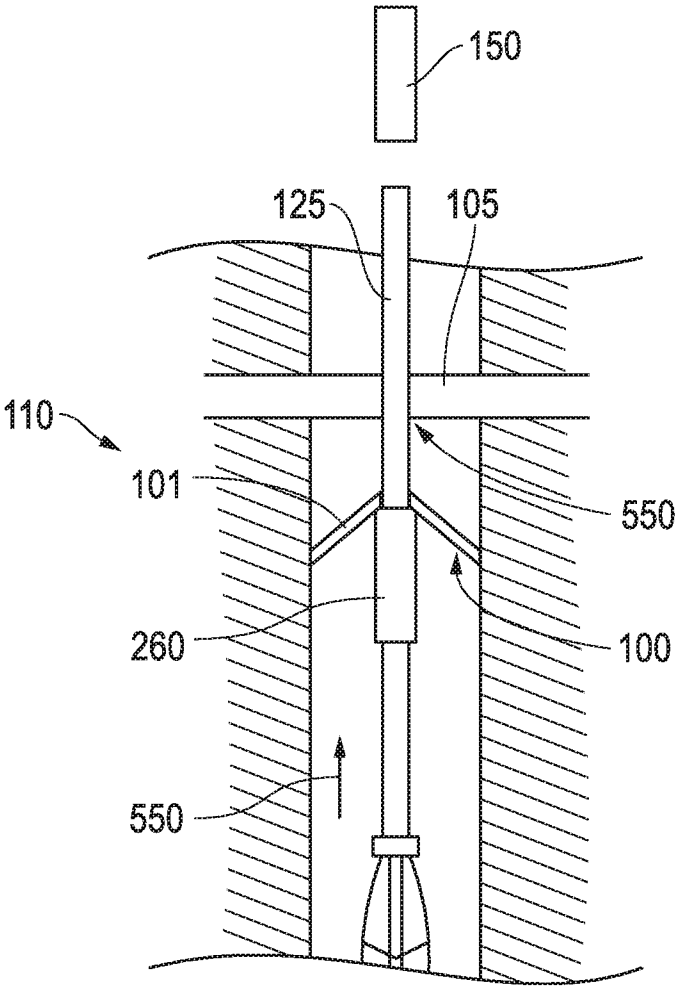
FIG. 5B is a side view of a tool of the toolstring of FIG. 2 being located within the blowout preventer of FIG. 1 by the locating device before advancement into the well of FIG. 3.
Figure 5A:
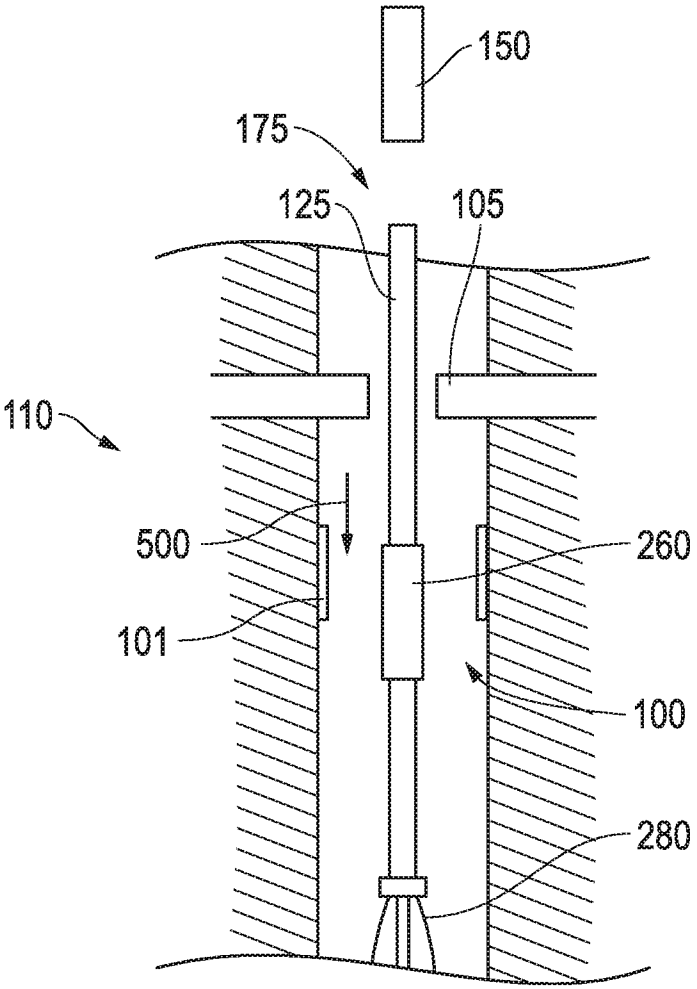
FIG. 5A is a side view of the toolstring of FIG. 2 being positioned within the blowout preventer of FIG. 1 for further assembly.

Referring now to FIGS. 5A and 5B, side views of the toolstring 175 of FIG. 2 are shown being positioned within the blowout preventer 110 of FIG. 1 during assembly. In this embodiment, the locating device 100 is unidirectional with the flappers 101 located against the sidewall 177 as the toolstring 175 is advanced downward (see arrow 500). As a matter of manufacturability and reliability, it may be preferable to utilize unidirectional flappers 101 in this manner. For example, once the toolstring 175 is moved downward, for example, by about the length of the most recently added deployment bar 125, the flappers 101 may be forcibly released back to a centralizing position.

Thus, as depicted in FIG. 5B, an upward pull on the toolstring 175 (see arrow 550) may deflect the flappers 101 sufficient to provide information as to the location of a tool component 260. With this information available, the operator may be alerted as to the availability of the deployment bar 125 for sealably closing against with the elements 105 and the next component 150 may be secured to the uppermost deployment bar 125. For sake of deployment, this process may be repeated with the addition of each new tool component. Of course, in other embodiments, for example, where flapper stability is less of a concern, bi-directional flappers 101 may be utilized. In such circumstances, the need to deploy and then pull back upward (e.g. 550) to confirm tool component location may be avoided given that the flappers 101 need not be initially retracted as shown in FIG. 5A. Instead, a sufficient downward deflection of the flappers 101 may alert the operator of tool component location.

Figure 6:
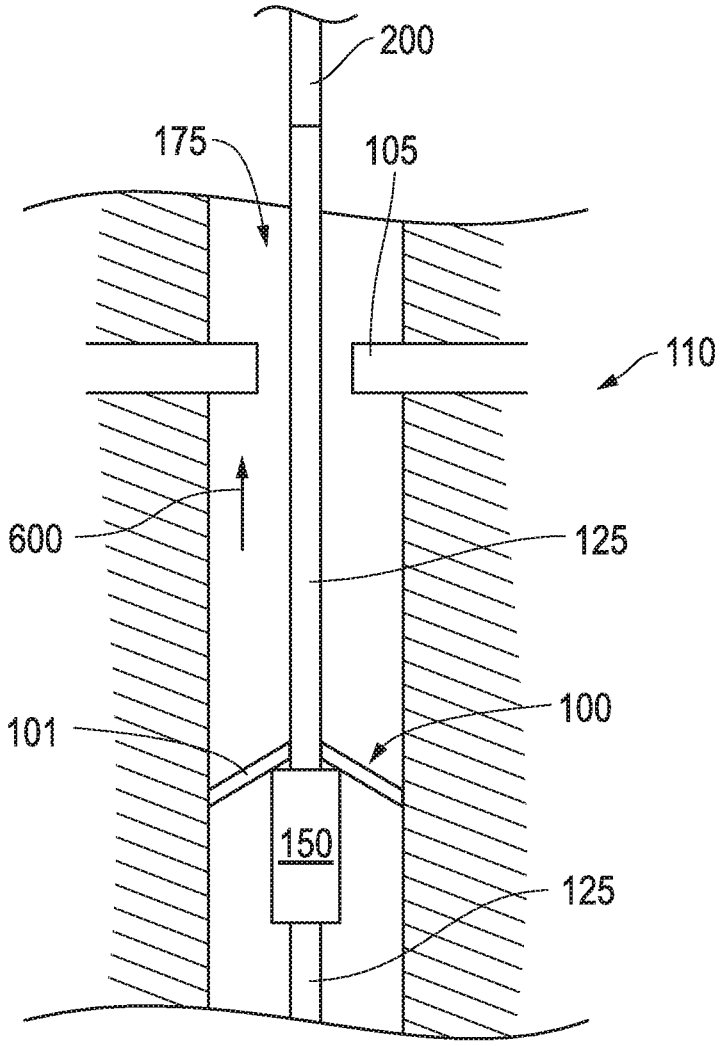
FIG. 6 is a side view of the toolstring of FIG. 2 with a tool thereof being located by the locating device of the preventer of FIG. 1 during removal from the well of FIG. 3.

Referring now to FIG. 6, a side view of the toolstring 175 of FIG. 2 is shown with a tool component 150 thereof being located by the locating device 100 of the preventer 110 of FIG. 1 during removal from the well 380 of FIG. 3. As discussed above, this particular locating may be of substantial benefit in coiled tubing applications. That is, the coiled tubing 200 that has been utilized to drive the logging application in the example discussed above may have traversed several thousand feet before finally being withdrawn upward (see 600) to retrieve the toolstring 175. However, given the potential vast depths involved and the extent of deformation that often occurs to the coiled tubing 200, the exact location of such components 150 may be difficult to ascertain, for example, with reference to only movement of the reel 310 (see FIG. 3). Thus, the direct indication of location provided by the locating device 100 may be of substantial benefit in preventing accidental closure of blowout preventer seal elements 105 on such components 150.

Figure 7:
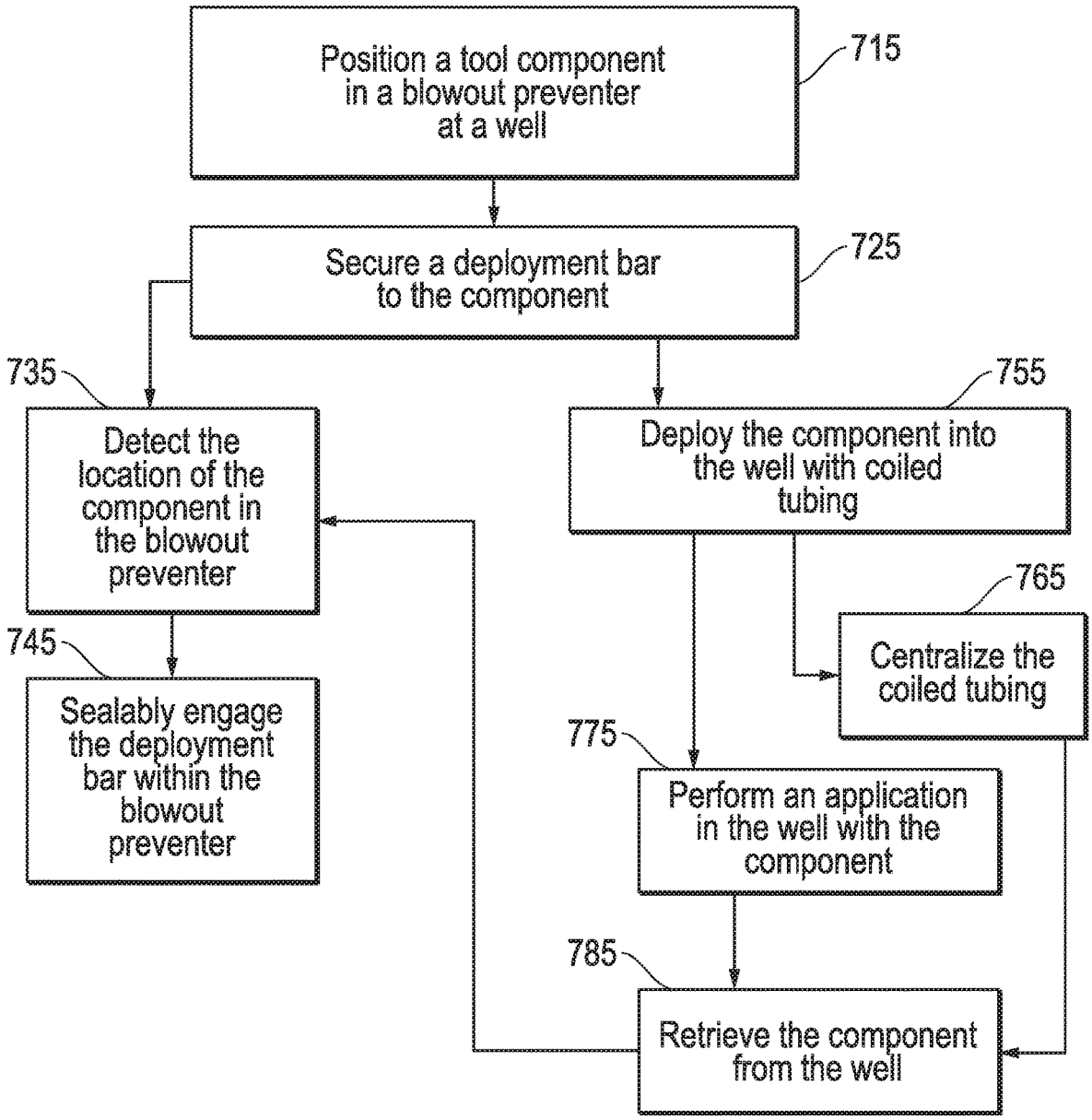
FIG. 7 is a flow-chart summarizing an embodiment of utilizing a tool locating device within a blowout preventer.

Referring now to FIG. 7, a flow-chart summarizing an embodiment of utilizing a tool locating device within a blowout preventer in combination with deployment bar(s) is shown. Specifically, as indicated at 715 and 725, tool components may be positioned within a blowout preventer and alternatingly secured to deployment bars. During this type of initial assembly and advancement, the location of the tool component may be confirmed as noted at 735 allowing for safe sealing engagement at a deployment bar as indicated at 745.

By the same token the component and deployment bar may be deployed into the well as part of a toolstring by way of coiled tubing (see 755). During this deployment and running of the application as indicated at 775, centralizing of the coiled tubing may be attained with the aid of the tool locating device in the blowout preventer (see 765). In fact, centralization may also be aided after the application during retrieval as indicated at 785. Once more, upon reaching the blowout preventer, the location of the tool component may again be ascertained as indicated at 735 for sake of safe sealable engagement as needed at a deployment bar (see 745).

Embodiments described hereinabove provide devices and techniques that allow for a reduction in height necessary to achieve effective coiled tubing deployment and retrieval of toolstrings of excessive lengths. Once more, the devices and techniques may be implemented in a manner that provides visibility to the toolstring during deployment or retrieval through a blowout preventer. Thus, as a practical matter, the risk of unintentionally sealing against tool segments or coiled tubing is reduced thereby helping to ensuring a better seal and enhancing safety from an operator perspective while also safeguarding the high dollar toolstring components.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, while embodiments herein are particularly beneficial for coiled tubing driven applications, the techniques may be employed on wireline, slickline, jointed pipe or other conveyances as well. Furthermore, the foregoing description should not be read as pertaining only to the precise structures described and shown in the accompanying drawings, but rather should be read as consistent with and as support for the following claims, which are to have their fullest and fairest scope.

I claim:

1. A method of positioning a toolstring having at least one deployment bar and at least one downhole tool component, the positioning of the toolstring occurring at a well through a blowout preventer at an oilfield accommodating the well with the aid of coiled tubing and comprising:

moving one of the coiled tubing and the at least one deployment bar through a channel of the blowout preventer defined in part by deflectable flappers adjacent thereto;

contacting at least one of the flappers with the at least one tool component of the toolstring;

detecting the contacting of the tool component to ascertain a position of the tool at the flappers within the blowout preventer;

ceasing the moving;

sealing the channel with seal elements at the at least one deployment bar based on the detecting of the tool component at the flappers;

releasing the seal elements to open the channel;

restarting the moving by forcibly advancing the toolstring through the well with the coiled tubing; and performing an application in the well.

2. The method of claim 1 further comprising imparting a force on the coiled tubing with the flappers during the advancing through the well for centralizing thereof.

3. The method of claim 1 further comprising:

positioning the at least one tool component and the at least one deployment bar in the channel prior to the sealing with the seal elements;

securing another tool component to the at least one deployment bar over the blowout preventer;

securing another deployment bar to the other tool component over the blowout preventer to form the toolstring; and securing the coiled tubing to the other deployment bar for the positioning of the toolstring.

4. The method of claim 3 wherein the flappers are unidirectional for deflection in an upward direction, the method further comprising:

retracting the flappers against a sidewall defining the channel prior to the positioning of the at least one tool component and the at least one deployment bar in the channel;

advancing the at least one tool component and the at least one deployment bar beyond the flappers within the channel;

releasing the flappers away from the sidewall; and withdrawing the deployment bar in an upward direction to initiate contact of the at least one tool component with the released flappers and confirm location within the blowout preventer.

5. The method of claim 4 further comprising imparting a force on the coiled tubing with the flappers during the withdrawing thereof through the well for centralizing thereof.

6. The method of claim 1 wherein the moving comprises retrieving the toolstring from the well, the retrieving comprising:

withdrawing the coiled tubing up through the channel of the blowout preventer with the at least one deployment bar, the contacting of the at least one of the flappers with the at least one tool component allowing the ascertaining of the position thereof at the flappers to confirm retrieval of the toolstring at the blowout preventer.

7. A method of moving a toolstring through a well via a conveyance running through a blowout preventer at an oilfield accommodating the well, the method comprising:

moving the conveyance within a channel of the blowout preventer;

imparting a force on multiple flappers within the channel to centralize the conveyance during the moving; and contacting at least one of the flappers with a tool component of the toolstring having a diameter larger than that of the conveyance for confirming a position of the component at the flappers, wherein the tool component is a first tool component, the toolstring being a segmented toolstring of at least one deployment bar and a plurality of tool components including the first tool component, the method further comprising sealing the toolstring at the at least one deployment bar in the channel in response to the contacting of the flapper with the first tool component.

8. The method of claim 7 wherein the confirming is a result of detecting one of changing load on the conveyance, changing load on the flapper, and deflection of the flapper.

9. The method of claim 7 wherein the flapper are bidirectional to allow deflection downward when the moving of the conveyance is in a downward direction through the channel and to allow deflection in an upward direction when the moving of the conveyance is in an upward direction through the channel.

10. A system comprising:

a blowout preventer over a well at an oilfield accommodating, the preventer having a channel therethrough defined in part by a tool locating device having a plurality of flappers, the tool locating device operating via deflection of the plurality of flappers;

a segmented toolstring for performing an application in the well and having a deployment bar and a plurality of tool components including a first tool component, the first tool component being locatable by the tool locating device when the flappers of the plurality of flappers are sufficiently deflected as the first tool component is positioned within the channel thereat, the plurality of flappers acting to centralize the segmented tool string; and at least one seal of the blowout preventer for sealing the segmented tool string by sealing against the deployment bar within the channel upon the locating of the first tool component via contact with at least one flapper of the plurality of flappers.

11. The system of claim 10 further comprising a conveyance for moving the segmented toolstring through the channel and the well.

12. The system of claim 11 wherein the conveyance is of an outer diameter that is substantially that of the deployment bar.

13. The system of claim 12 wherein the first tool component is at least ⅛ of an inch larger in diameter than the conveyance and the deployment bar.

14. The system of claim 12 wherein the conveyance is one of coiled tubing, wireline, slickline and jointed pipe.

15. The system of claim 14 wherein the conveyance is coiled tubing, the deployment bar configured to support fluid flow therethrough.

16. The system of claim 11 wherein the plurality of flappers comprises at least two hinged flappers with tapered surfaces for interfacing one of the conveyance, the segmented toolstring and each other.

17. The system of claim 16 wherein the hinged flappers are powered to effect the centralization of the segmented tool string.

* * * * *